US005207274A

United States Patent [19]

Streich et al.

[11] Patent Number: 5,207,274

[45] Date of Patent: May 4, 1993

[54] APPARATUS AND METHOD OF ANCHORING AND RELEASING FROM A PACKER

[75] Inventors: Steven G. Streich; Kevin T. Berscheidt, both of Duncan, Okla.

[73] Assignee: Halliburton Company, Duncan, Okla.

[21] Appl. No.: 744,192

[22] Filed: Aug. 12, 1991

[51] Int. Cl.[5] ..... E21B 23/00

[52] U.S. Cl. ..... 166/382; 166/124; 166/181

[58] Field of Search ..... 166/377, 382, 123, 124, 166/181, 182

[56] References Cited

U.S. PATENT DOCUMENTS 3,633,670 1/1972 Brown et al. ..... 166/125
4,060,131 11/1977 Kenneday et al. ..... 166/382
4,305,465 12/1981 Ellis ..... 166/382
4,363,358 12/1982 Ellis ..... 166/181 X
4,391,326 7/1983 Greenlee ..... 166/382 X
4,660,637 4/1987 McGill et al. ..... 166/134 X
4,862,957 9/1989 Scranton ..... 166/124 X
5,074,361 12/1991 Brisco et al. ..... 166/98 X

*Primary Examiner*—William P. Neuder
*Attorney, Agent, or Firm*—James R. Duzan; C. Dean Domingue

[57] ABSTRACT

An apparatus and method of anchoring into a packer with a stinger assembly is disclosed. Further, an apparatus and method of releasing from a packer is also disclosed. The apparatus includes an elongated stinger member, a plurality of collet finger members slidably attached to the stinger, a shear ring member with a chamfered shoulder containing a plurality of splined extensions, with a plurality of shear pins contained through the shear ring member. Further, the apparatus includes a load ring attached to the elongated stinger for transferring the load of the downhole tool from the collet finger members to the load ring.

20 Claims, 5 Drawing Sheets

APPARATUS AND METHOD OF ANCHORING AND RELEASING FROM A PACKER

BACKGROUND OF THE INVENTION

The invention relates to downhole tools used in oil and gas wellbores. More particular, but not by way of limitation, the invention relates to downhole apparatus used to anchor a work string to a packer as well as to release the anchoring device from the packer.

In the past, packers such as the Drillable-Test-Treat and Squeeze Packers have been utilized in a number of different applications in the oil and gas industry. Other packers, such as the packer that was disclosed in U.S. Pat. No. 4,151,875 to Sullaway also contain similar features to the Drillable-Test-Treat and Squeeze Packers.

Before beginning the test, treat or squeeze function, the operator is required to sting into the top of the packer with the workstring; this is also known as anchoring into the packer. Afterwards, the anchoring apparatus is pulled out of the wellbore.

Next, it necessary to retrieve the packer from the wellbore. Basically, there are two methods utilized. The first method utilizes drilling the packer out with a Rock Bit. In utilizing this particular method, the packer is literally drilled out of the wellbore.

The second method comprises milling over a portion of the packer and utilizing an overshot to pick-out the packer.

The present invention allows for anchoring a stinger assembly to the packer and subsequently retrieving the stinger assembly. A common problem encountered while releasing from the packer is for the stinger assembly to become stuck. Once the stinger assembly becomes stuck, many times the only way of retrieving the work string is to part the work string at some point above the stinger, thus, leaving a portion of the work string above the packer in the wellbore. This situation, as will be appreciated by those skilled in the art, presents major difficulties.

Therefore, there is a need for a tool that will easily and effectively anchor a stinger assembly to a downhole packer during drill, test, treat or squeeze operations. Moreover, there is a need for a tool that will provide for an emergency release in the event the anchoring tool becomes stuck in the packer.

SUMMARY OF THE INVENTION

The present invention includes both apparatus and method claims for an anchoring apparatus with an emergency release stinger assembly in the event the anchoring apparatus becomes stuck while releasing from the downhole packer.

The stinger assembly comprises a stinger member, means for threadily mating the stinger into the downhole device, means for engaging the threadily mating means with the upper thread means of the downhole packer and means for releasing the engaging means. Also, means for providing resistance to torque is included.

One feature of the invention is the shear ring member which is slidably mounted on the stinger. Another feature includes the angle of the shoulder of the shear ring member which is complementary to the angle of the collet finger members. Yet another feature includes the shear pins which secure the shear ring member to the stinger assembly member.

An advantage of the invention includes the angle of the collet finger and the angle of the shear ring member which are complementary and cooperate with one another, which allows the load to be concentrated between these two points. Another advantage is the shear pins in the shear ring member which allows for freeing the shear ring member relative to the stinger assembly. Yet another advantage includes the load ring which will cooperate with the collet finger member and allows for the concentration of the load to be focused on the load ring once the shear pins in the shear ring member have sheared.

DESCRIPTION OF THE PREFERRED EMBODIMENT

Figure 1:
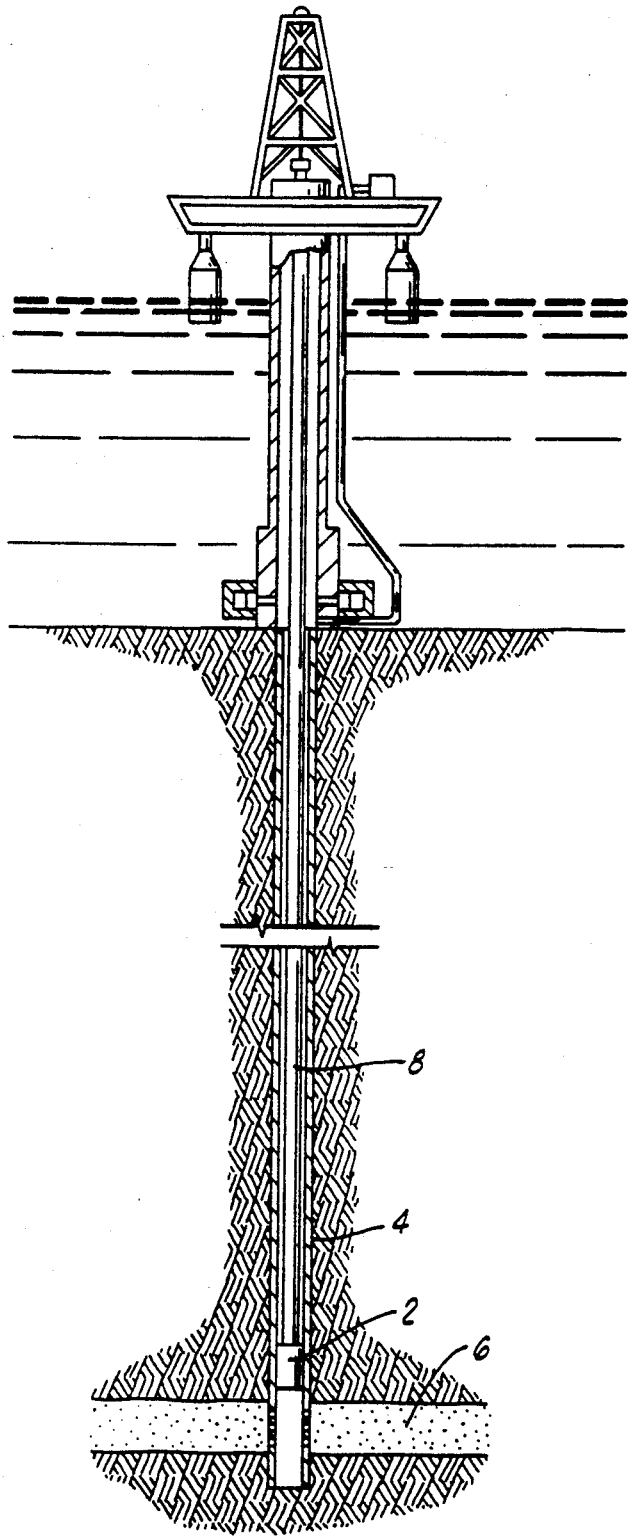
FIG. 1: A typical oil and gas derrick, and work string suspended in a wellbore that penetrates a hydrocarbon zone.

In oil and gas operations, many times an operator finds it desirable to isolate a particular hydrocarbon bearing zone that is penetrated by casing string. The purpose of isolating may be to test, treat or squeeze the particular hydrocarbon zone. In order to isolate the zones, a packer in a wellbore is utilized, as shown in FIG. 1. One of the variety of packers which may be employed is the Drillable-Test-Treat and Squeeze Packer (DTTS) which may be purchased from Halliburton, assignee of the present invention. Another packer which may be employed is the EZ Disposable Packer found in U.S. Pat. No. 4,151,875 by Sullaway, and assigned to Halliburton.

Referring to FIG. 1, the general purpose of these packers is to isolate from the wellbore 4, a particular zone 6. The packer 2 may contain a valve, and through various manipulations and/or pressure increases in the work string, the various test, treat or squeeze functions may be utilized as will be appreciated by those skilled in the art.

Before beginning the test, treat or squeeze operations, it is necessary to anchor the work string 8 to the packer 2. Afterwards, the anchoring apparatus is pulled out of the wellbore 4 while the packer 2 remains seated in the wellbore.

Once the function of the packer 2 has been completed (testing, treating and/or squeezing), the packer must be removed from the wellbore. Generally, this is accomplished by drilling or milling through the packer; thus, the name drillable, test, treat and squeeze.

Drilling techniques employed may vary as noted earlier in this application. Many times, the operator will mill over the packer to effectively remove the packer 2.

Also, a mill and overshot can be utilized, which allows for milling over a section of the packer 2, and then grabbing (or picking-up) the packer with the overshot.

With reference to the figures, please note that like numbers refer to like parts in the various illustrations of this application.

Figure 2A:
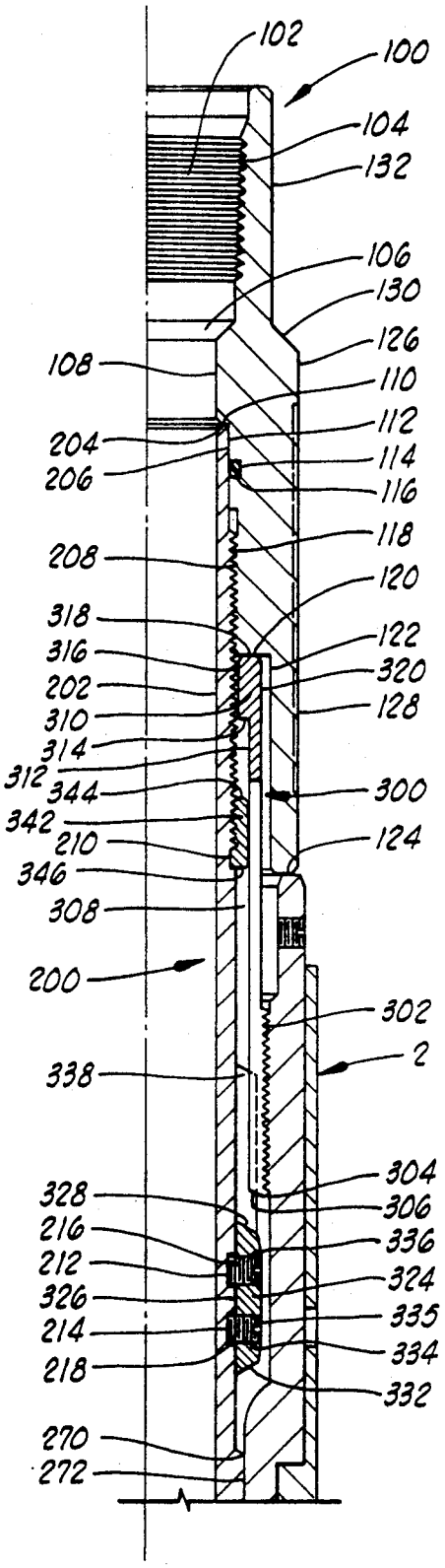
FIGS. 2A–2B: Vertical quarter section elevation of the stinger assembly stinging into the top of a packer.

In the preferred embodiment, and referring to FIG. 2A, the invention includes a top adapter sub, generally at 100, which is also known as the power mandrel 100. The top adapter sub contains an internal bore 102 therethrough. A first internal surface contains thread means 104, having in turn a second surface containing a chamfered surface 106 with a third surface containing a smooth bore 108. A radially flat shoulder 110 extends inward to a fourth surface containing a sealing bore 112 which has a recessed portion 114 that will contain an elastomeric member 116.

Sealing bore 112 has, in turn, a portion defining internal threads 118 which leads to radially flat shoulder 120. Extending therefrom is fifth surface 122 terminating at shoulder 124.

The outer diameter of the top adapter sub 100 contains a first surface 126 having defined thereon wrenching flats 128. Extending from the first surface 126 is chamfered surface 130 which, in turn, leads to final outer diameter surface 132.

The elongated stinger is generally shown at 200; the stinger 200 has an internal bore surface 202 therethrough. Extending radially outward from internal bore surface 202 is end 204 which abuts the radially flat shoulder 110 of the top adapter sub 100.

A first sealing surface 206 is contained on the outer diameter of the stinger 200 which extends to an internal thread connection 208 which threadily mates with the internal thread 118 of the top adapter sub 100. On the outer diameter of the stinger 200 is a second surface containing a recessed groove 210 as well as a plurality of apertures, shown at 212 and 214 for placement of shear pins 216 and 218, respectfully.

Figure 2B:
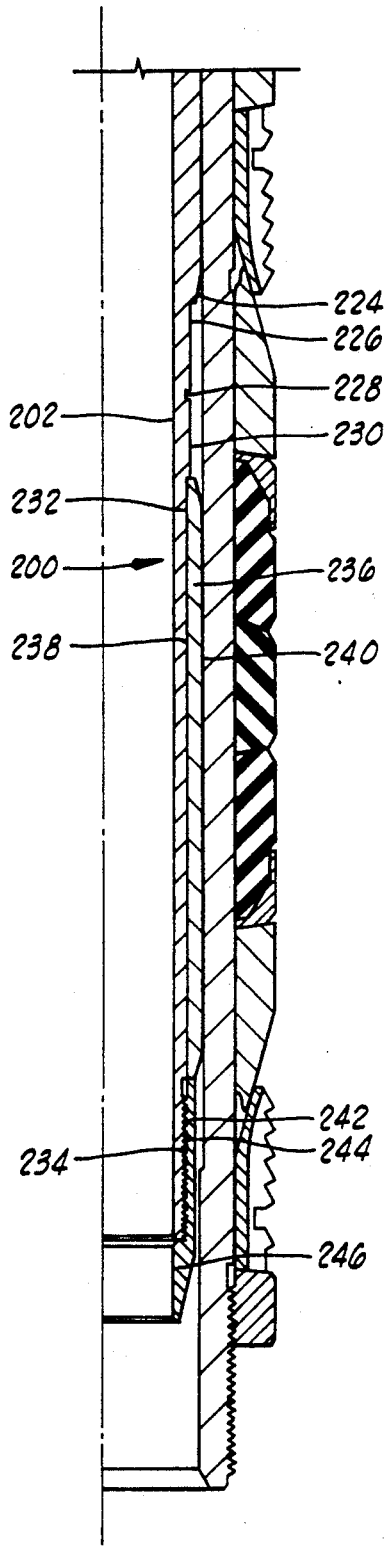

The outer diameter of the stinger 200 further contains tapered shoulder 220 which terminates at outer diameter surface 222, which in turn, contains a second tapered surface 224 as seen in FIG. 2B. A third outer diameter surface 226 extends therefrom, with outer diameter surface 226 containing a recessed portion 228. The third outer diameter surface terminates at radially flat shoulder 230; and, extending from radially flat shoulder 230 is the fourth outer diameter bore surface 232, which has in turn, external thread means 234.

A stinger fitting 236 has an internal bore 238 which surrounds the elongated stinger's fourth outer diameter bore surface 232, and an outer diameter sealing bore 240. An end cap 242 has an internal thread portion 244 which threadily mates with the elongated stinger's fourth outer diameter bore surface external threads 234. The end cap 242 terminates within cap shoe 246.

Also provided are means for threadily mating the elongated stinger 200 into the top of the downhole device such as the packer 2. Referring to FIG. 2A, the thread means includes a plurality of collet finger members, seen generally at 300. Defined on the outer diameter of each collet finger member 300 is a thread 302. In the preferred embodiment, the thread design will be a front angle thread; however, other thread designs can be utilized, such as a back angle thread. Moreover, the top of the packer 2 will have a complementary type of thread so that the two can be mated together.

Extending from the threads 302 will be first angled end at 304, and having complementary second angle end 306. On the inner diameter of the collet finger member 300 is internal bore 308.

Figure 5:
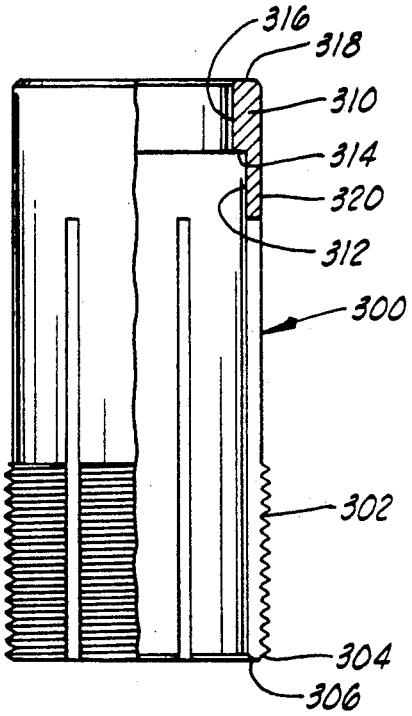
FIG. 5: Comprises a sectional elevation of the collet finger members with threads.

Referring to FIG. 5, the plurality collet finger members 300 terminate at tubular housing member 310, which has an internal surface 312. The collet finger members are attached to the tubular housing member 310 such that the fingers can be secured by welding, threading or pinning. In the preferred embodiment, the tubular housing member and collet finger members are all machined from the same piece of stock and thus comprise one member.

The internal surface 312 terminates at radially extending inward shoulder 314, which in turn contains internal surface 316 terminating at end face 318. The top adapter sub shoulder 120 and end face 318 will abut when the tool is engaged into the top of the packer 2.

On the outer diameter of the tubular housing member 310 is first surface 320, with first surface 320 extending to and being attached with collet fingers member 300.

Figure 3A:
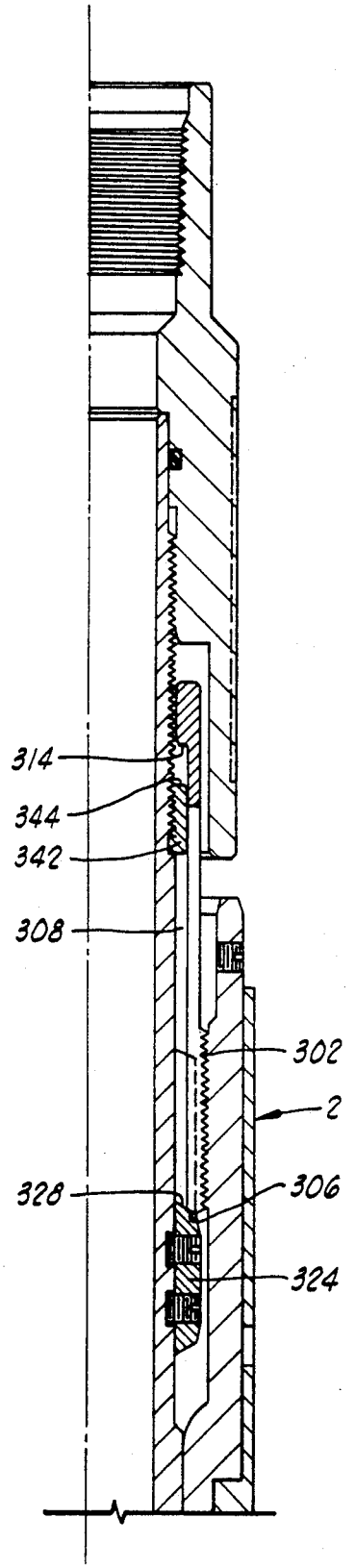
FIGS. 3A–3B: Vertical quarter section elevation of the stinger assembly as the work string is under a tensile load.
Figure 3B:
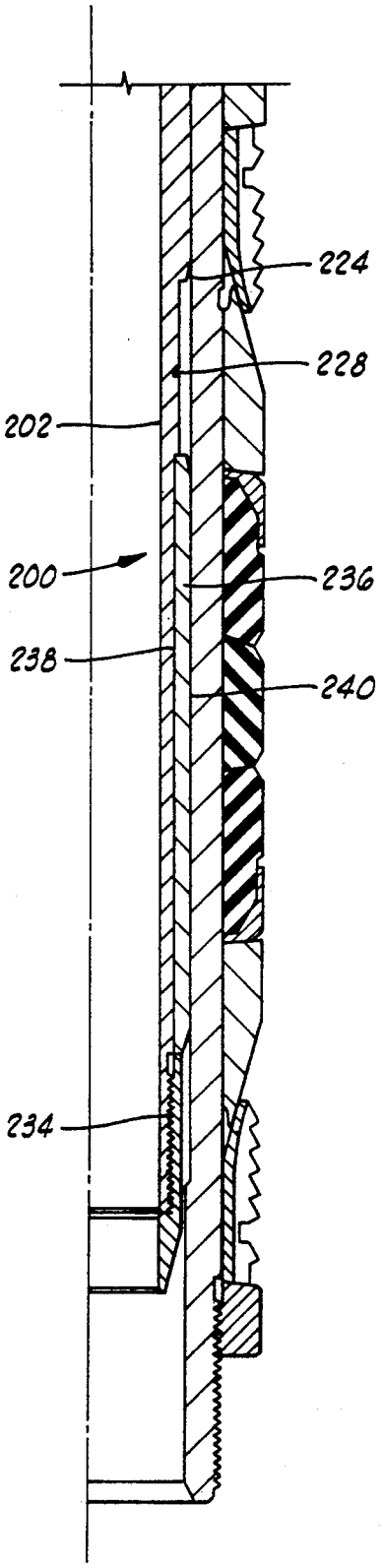

Also provided are means for engaging the threadily mating means with the upper end of the packer 2. Referring to FIG. 2A, the engaging means includes a shear ring member 324, with an internal bore 326. The internal bore 326 terminates at chamfered surface 328, the angle of chamfered surface 328 being complimentary to the angle of the collet finger members second angled end 306. Referring to FIG. 3A, one can see that the second angled end 306 and chamfered surface 328 will abut one another. At this point, the load is concentrated on surface 328 and the angle keeps the collet finger member 300 in the packer mandrel threads.

Referring back to FIG. 2A, on the outer diameter of the shear ring is surface 335 which terminates at a second chamfered surface 332. The shear ring member 324 has bored therethrough a plurality of shear pin apertures 334. Shear pins 216, and 218 are inserted therethrough and into the apertures 212, 214 of the stinger member 200. The plurality of shear pins 216, 218 fitted into the apertures comprises the means for releasing the engaging means.

A load ring 342 is placed about the periphery of the stinger assembly in the recess groove 210. The load ring has a first end 344 and a second end 346.

Attached to the shear ring member 324 are a plurality of splined extensions 338 which cooperate with the collet finger members 300. The splined extensions 338 can be attached by welding, screwing, pinning or machining from the same piece of stock which was used to fabricate the shear ring.

As more fully described in the operation of the invention, means for providing resistance to torque is also disclosed. The means for resistance includes the circular member 324, or shear ring member, containing the plurality of holes 334, 336. Further, there is the splined extension 338 which will cooperate with the collet fingers. Finally, the shear pins 216, 218, are engaged in the holes and into the body of the stinger 200.

OPERATION OF THE PREFERRED EMBODIMENT

With respect to FIG. 1, the elongated stinger 200 (not shown) is stung into the top of the packer 2. At this point, the collet finger members 300, and the threads 302, will engage into the threads of the top of the packer; thus, anchoring is accomplished by setting weight on the top of the packer. In order to release the stinger assembly, the work string 8 is picked up. Put another way, tension is applied to the work string. Then, the work string 8 is rotated clockwise.

As noted earlier, collet finger members 300 are cooperating with the splined extension 338 such that when the work string is rotated, the splined extension 338 will turn the collet finger members 300. Referring to FIG. 3A, the second end angle 306 will abut chamfered surface 328 with the shear ring member 324. By continuing to rotate, the collet member fingers will be forced downward into chamfered surface 328 which will act to engage the threads 302 into the top of the packer 2. Continued rotation will allow for releasing of the stinger 200 from the packer 2.

In the past, in the event that continued rotation was not possible due to debris settling in the top of the packer, or for any other reason, it was necessary to cut the tubing above the stinger and leave the stinger and packer in the wellbore. However, the release mechanism of the present invention solves this problem.

Figure 4A:
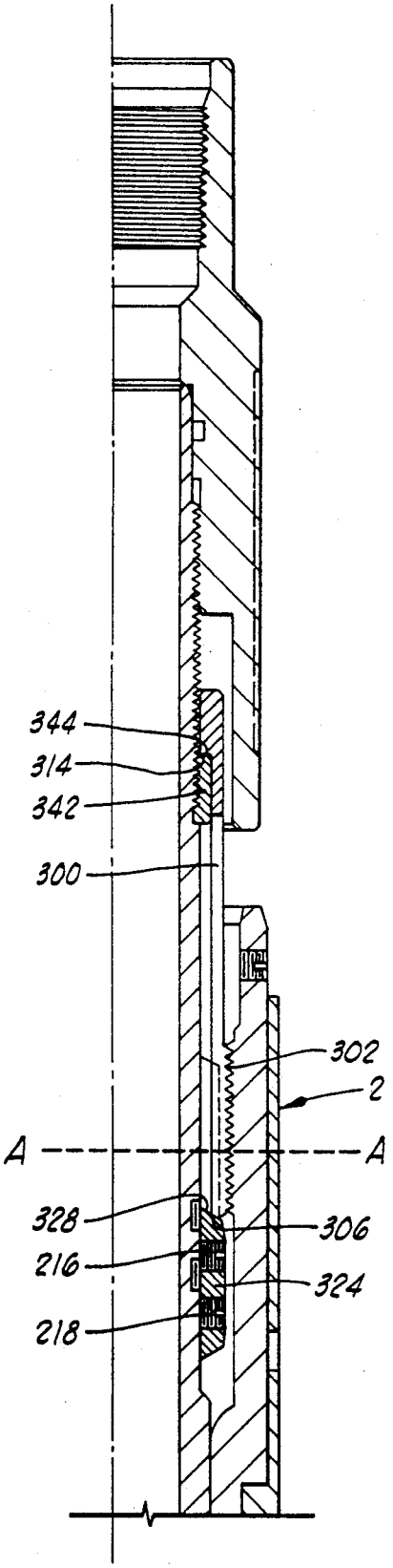
FIGS. 4A–4B: Vertical quarter section elevation of the stinger assembly after the shear pins have been sheared and the load is concentrated on the load ring.
Figure 4B:
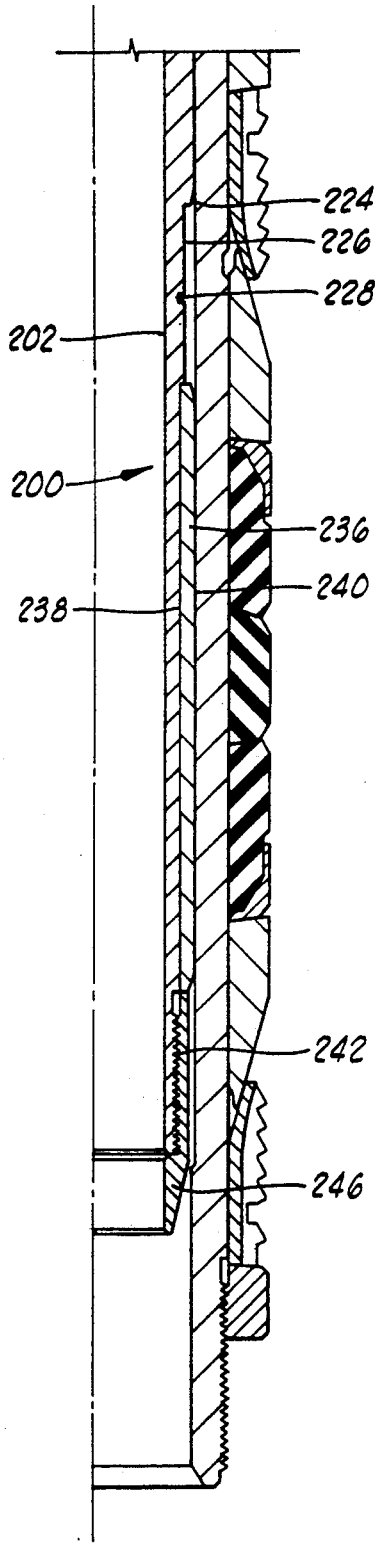
Figure 6:
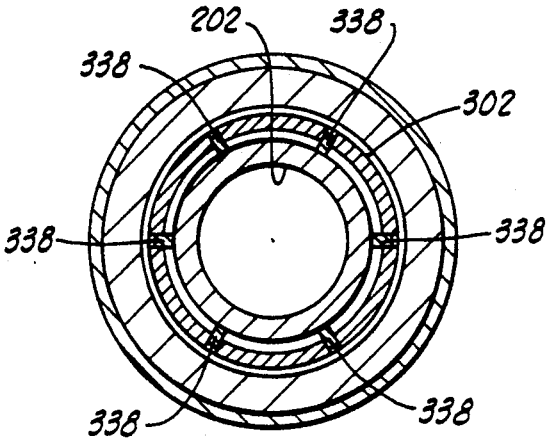
FIG. 6: Comprises a sectional elevation along line A—A of FIG. 4A, showing the cross-section of the stinger and spline members of the shear ring.

The operator will apply tension to the work string 8. This tension is transmitted to stinger 200. At this point, the chamfered surface 328 is acting against the second angle end 306 of the collet finger member 300. As shown in FIG. 4A, once a predetermined force has been applied, the shear pins 216, 218, located in the shear ring member 324 will shear. Further pull on the work string will result in the stinger and load ring 342 moving longitudinally upward. Then, the first end 344 of the load ring 342 will abut the shoulder 314 in the collet finger member tubular housing 310. Continued upward pulling on the work string will result in the load being concentrated at the first end 344 of the load ring 342, with first end 344 opposing shoulder 314. Because the shear ring member 324 has now been allowed to shift longitudinally downward relative to the stinger 200, the collet finger members 300 are free to retract and by pulling on the work string further, and concentrating the load at the first shear end 344 of the load ring 342, the stinger 200 can be pulled out of the wellbore 4. FIG. 6 shows the cross-section of the stinger and spline members of the shear ring taken along line A—A of FIG. 4A.

Thus, it is apparent that the apparatus of the present invention readily achieves the advantages mentioned as well as those inherent therein. While certain preferred embodiments of the invention have been illustrated for the purpose of this disclosure, numerous changes in the arrangement and construction of parts may be made by those skilled in the art, which changes are embodied within the scope and spirit of the present invention are defined by the appended claims.

I claim:

1. An apparatus for releasing a downhole device having thread means in the upper end, said apparatus comprising:

an elongated stinger member;

means for threadily mating said stinger;

with the upper thread means of the downhole device;

a top adapter sub extending from said elongated stinger member, said top adapter sub defining a shoulder therein;

a load ring disposed on said elongated stinger member and adapted for applying a load to said shoulder when removing the apparatus from the downhole device; and means for releasing said means for threadily mating when removing the apparatus.

2. The apparatus of claim 1, wherein said means for threadily mating comprises a plurality of collet finger members attached to a tubular housing, said collet finger members comprising thread means and said tubular housing comprising a protuberant member so that the protuberant member is slidably positioned between said shoulder in said top adapter sub and said load ring.

3. A method of anchoring into a packer in a wellbore with a stinger assembly on a work string, said stinger assembly containing a collet finger member, a shear ring, and splined extension members extending therefrom, said method comprising the steps of:

(a) stinging into the packer with the stinger assembly;

(b) slacking off the weight of the work string on the packer via the stinger assembly so that the collet member engages in the top of the packer;

(c) rotating the work string in a first direction so that the splined extension members of the shear ring impart torque to the packer via the collet finger member; and (d) applying tension to the drill string in order to release the packer.

4. A method of releasing a stinger assembly on a work string from a packer, said stinger assembly containing a collet finger member, a shear ring housing with shear ring extending therethrough, and splined extension member extending therefrom, said method comprising the steps of:

(a) stinging into the packer with the stinger assembly;

(b) slacking off the weight of the work string on the packer via the stinger assembly so that the collet member engages in the top of the packer; and (c) rotating the work string in a first direction so that the splined extension members of the shear ring impart torque to the packer via the collet finger member.

5. The method of claim 4, further comprising the steps of:

(d) applying tension to the work string so that the shear housing acts against the collet finger member; and (e) shearing the shear pins contained in the shear housing.

6. The method of claim 5, further comprising the steps of:

(f) applying tension to the work string so that the load is concentrated on the load ring via a protuberant member of the collet finger member; and (g) disengaging the collet finger member from the top of the packer.

7. Apparatus for releasing a downhole device having thread means in the upper end, said apparatus comprising:

an elongated stinger member with a first end and a second end, and a plurality of apertures formed on the outer periphery of said elongated stinger member;

means for threadily mating said stinger into the downhole device;

means for engaging said threadily mating means with the upper thread means of the downhole device;

a load ring attached about the outer periphery of said elongated stinger member;

a top adapter sub threadily connected to the first end of said elongated stinger member, said top adapter sub having defined thereon an internal shoulder;

a plurality of collet finger members attached to a tubular housing, said collet finger members having defined thereon thread means and said tubular housing having a protuberant member so that the protuberant member is slidably engaged between the internal shoulder of said top adapter sub and said load ring;

a shear ring member with a chamfered shoulder, said shear ring member being arranged about the outer periphery of said elongated stinger member and having a plurality of apertures formed therethrough;

a plurality of splined extensions, said splined extensions being attached to said shear ring member and cooperating with said plurality of collet finger members; and means for releasing said engaging means.

8. The apparatus of claim 7, wherein said releasing means comprises:

a plurality of shear pins contained through the apertures formed on said shear ring member and apertures formed on said elongated stinger member.

9. The apparatus of claim 8, wherein said plurality of collet finger members has formed at one end an angled shoulder.

10. The apparatus of claim 9, wherein said angled shoulder of said collet finger is complementary to the chamfered shoulder of said shear ring so that said angled shoulder cooperates with said chamfered shoulder.

11. Apparatus for entry into a packer and retrieving the apparatus comprising:

a stinger assembly with a first end and a second end, said stinger assembly having a portion defining a plurality of apertures;

a ring member with a first end and second end slidably disposed about said stinger assembly;

a plurality of collet fingers formed on the second end of said ring member;

means, attached to said stinger assembly, for providing resistance to torque;

a plurality of splined extensions being attached to said shear ring member and cooperating with said plurality of collet fingers;

a circular member with a plurality of shear pin holes formed therethrough; and a plurality of shear pins extending through the shear pin holes of said circular member and into the apertures of said stinger assembly.

12. Apparatus for entry into a packer and retrieving the apparatus comprising:

a stinger assembly with a first end and a second end, said stinger assembly having a portion defining a plurality of apertures;

a ring member with a first end and second and slidably disposed about said stinger assembly;

a plurality of collet fingers formed on the second end of said ring member;

means, attached to said stinger assembly, for providing resistance to torque;

a power mandrel threadily connected to the first end of said stinger assembly, said power mandrel having defined thereon an internal shoulder; and means, attached about the periphery of said stinger assembly, for supporting a load.

13. The apparatus of claim 12, wherein said load means comprises:

a load ring, said load ring being attached about the outer periphery of said stinger assembly.

14. The apparatus of claim 13, wherein said ring member has defined thereon a protuberant member, said oblique member being slidably engaged about said stinger assembly between the internal shoulder of said power mandrel and said load ring.

15. The apparatus of claim 14, wherein said circular member has a chamfered shoulder.

16. The apparatus of claim 15, wherein said collet fingers have formed at the second end an angular shoulder.

17. The apparatus of claim 16, wherein said angular shoulder of said collet fingers is complementary to the chamfered shoulder of said shear ring so that angled shoulder cooperates with said chamfered shoulder.

18. An apparatus for releasing a downhole device having thread means in the upper end, said apparatus comprising:

an elongated stinger member;

a tubular housing slidably disposed on said stinger member;

a plurality of collet fingers extending from said tubular housing and slidable therewith;

a shear ring disposed on said stinger member and adapted for holding said collet fingers in engagement with the thread means of the downhole device; and a plurality of splined extensions extending from said shear ring member and engaging said collet finger member.

19. The apparatus of claim 18 further comprising a shear pin connecting said shear ring member to said stinger member and adapted for shearing in response to an upward force on said stinger member whereby said shear ring member is moved such that said collet fingers are disengagable from the thread means of the downhole device.

20. The apparatus of claim 18 wherein:

said collet finger members have an angled shoulder at an end thereof; and said shear ring member has an angled shoulder adapted for engagement with said angled shoulder on said collet finger members.

* * * * *